United States Patent [19]

Caplin

[11] Patent Number: 4,482,359

[45] Date of Patent: Nov. 13, 1984

[54] FLUIZIDED BED METHOD AND APPARATUS FOR PRODUCING A COMBUSTIBLE GAS

[75] Inventor: Peter B. Caplin, Sunbury on Thames, England

[73] Assignee: The Energy Equipment Company Limited, Bedforshire, England

[21] Appl. No.: 400,089

[22] Filed: Jul. 20, 1982

[30] Foreign Application Priority Data

Jul. 28, 1981 [GB] United Kingdom ..... 8123161
Aug. 19, 1981 [GB] United Kingdom ..... 8125373

[51] Int. Cl.[3] ..... C10J 3/54; C10J 3/56; C10J 3/86

[52] U.S. Cl. ..... 48/89; 48/63; 48/67; 48/73; 48/197 R; 48/202; 48/206; 422/141; 422/143; 422/146

[58] Field of Search ..... 422/141, 142, 143, 146; 48/73, 77, 63, 67, DIG. 4, 202, 206, 197 R, 89; 165/104.16; 122/4 D; 110/245

[56] References Cited

U.S. PATENT DOCUMENTS

| | | | |
|---|---|---|---|
| 2,468,508 | 4/1949 | Munday | 422/143 |
| 2,527,197 | 10/1950 | Rollman | 422/142 |
| 2,662,816 | 12/1953 | Kalbach | 48/202 |
| 2,973,251 | 2/1961 | Sprague | 422/146 |
| 4,184,455 | 1/1980 | Talmud | 110/245 |
| 4,337,066 | 6/1982 | Kunii | 422/141 |

*Primary Examiner*—S. Leon Bashore
*Assistant Examiner*—K. M. Hastings
*Attorney, Agent, or Firm*—Murray Schaffer

[57] ABSTRACT

A combustible gas producer plant is described in which a finely divided inert particulate material fluidized bed is divided into a first, combustible-gas producing section and a second, heating section, to both of which sections fuel is fed. Heat transfer, by bed material migration, from the second to the first section sustains the reaction in the first section leading to the production of combustible gas. A diaphragm water wall divides and surrounds the volumes above bed sections and is part of a boiler generating steam used (optionally with added oxygen) to fluidize the first bed section. The steam is also used to fluidize the bed material at the boundary of the bed sections and prevent in-bed gas migration across that boundary. The second section of the bed is fluidized with air or an air/inert gas mixture. Fluidization is effected with sparge tubes and the plant may include evaporator, superheater and economizer sections for the boiler.

10 Claims, 3 Drawing Figures

FLUIZIDED BED METHOD AND APPARATUS FOR PRODUCING A COMBUSTIBLE GAS

DESCRIPTION

1. Field of Invention

The invention concerns methods of making and plant for producing combustible-gas, in particular when utilising fluidised bed gas generators.

2. Background Art

Recently proposals have been made for fluidised bed hot gas generators in which a bed of finely divided inert particulate material is fluidised by means of an array of sparge tubes or pipes extending generally horizontally through the bed material, to which pipes air (or a mixture of air with inert gas) is fed to fluidise and support combustion fuels fed to the bed.

The partial combustion of fuel fed to such an arrangement produces a gas having a calorific value until a point is reached—with increasing reduction of the air-to-fuel ratio—when the exothermic reaction in the bed becomes autothermic or balanced at a particular temperature. The production of gases of higher calorific value requires an endothermic reaction to take place and necessitates the provision of an external heat supply to the bed if the reaction is to be sustained. With the fluidised bed arrangements disclosed elsewhere, this balance point represents the upper, practicable, limit for combustible-gas production as any further decrease in the air-to-fuel ratio fed to the bed results in a drop in bed temperature and loss of combustion.

OBJECT OF THE INVENTION

An object of the invention is to alleviate or overcome the difficulties found with meeting the fundamental requirement when operating a fluidised bed endothermically of providing a source of heat external to the bed.

DISCLOSURE OF THE INVENTION

One aspect of the present invention provides a method of making combustible-gas in which a bed of finely divided inert particulate material is fluidised and has fuel fed thereto for combustion, in which the bed is divided into one or more first sections operated endothermically to produce a combustible-gas and one or more second sections operated exothermically to produce heat, wherein heat produced in the or each second section is transferred to the or each first section by migration of bed material between the different bed sections and wherein the gases evolving from the different bed sections are maintained separate.

A second aspect of the invention provides combustible gas producer plant comprising a bed of finely divided inert particulate material and means for fluidising and for feeding fuel to the bed, wherein the bed is divided into one or more first sections operable endothermically to produce a combustible-gas and one or more second sections operable exothermically to produce heat, wherein means are provided enabling heat produced in the or each second section to be transferred to the or each first section by migration of bed material between the different bed sections but preventing migration of gas between the different bed sections, and wherein means are provided maintaining gases evolving from the different bed sections separate.

With advantage I provide one first bed section and one second bed section.

The volumes above the different bed sections form extensions of the gas flows from those bed sections and are strictly divided by gas impermeable walls (ideally diaphragm water walls forming part of a boiler) which dip into the bed when it is fluidised to form divisions between the different bed sections.

The isolation of the differing bed sections in this way, and of the volumes above the differing bed sections, has the result that gases produced in the endothermically operating gas producing bed section are kept separate from the exhaust gases evolving from the rest of the bed.

The invention may provide that steam be injected into the bed at the boundaries of the different bed sections to prevent gas migration between the different bed sections.

With advantage the means for fluidising the or each first bed section comprises a first array of sparge tubes, the means for fluidising the or each second bed section comprises a second array of sparge tubes and the means within the bed for preventing migration of gases between the different bed sections comprises a third array of sparge tubes, the sparge tubes of each of the first, second and third arrays of sparge tubes being arranged to extend generally horizontally through the bed material and the sparge tubes of the third array of sparge tubes being located at positions defining the boundaries of the first and second bed sections.

It will be appreciated from the above comments that the gases generated in each section of the bed are fundamentally different. The endothermically operated, combustible-gas producing bed section generates a reducing gas; whilst the exothermically operated or heating bed section evolves fuel gases burnt with a slight excess of air and which are oxidising.

I propose that the exothermically operated heating bed section include controls for regulating the stoichiometric ratio and thermal capacity and response to demand placed on the bed (which may be inferred or deduced from the temperature of this bed section, which valve will be co-related in the control system with the actual load in terms of gas produced in the exothermically operating bed section). The burden of providing any necessary cooling of the exothermically operated bed section (which could be achieved either by injection of steam and combustion air thereinto or by injection of recycled flue gas) is with embodiments of the invention now proposed reduced, at least in part, by transferring heat from the exothermically operated bed section to the endothermically operated, combustible-gas producing bed section. Turbulence within the fluidised bed leads to part of the fuel and carbon in the exothermically operated bed section penetrating into the gas-producing bed section and provides all or a major part of the necessary carbon needed there to support the water reaction taking place therein.

I propose that the endothermically operating, combustible gas producing bed section, be fed separately with steam to effect fluidisation, which steam is also utilised to react with the carbon in this bed section. This steam, which may or may not be oxygen enriched, reacts with the carbon in that bed section to produce hydrogen and a mixture of carbon monoxide and carbon dioxide with substantially no nitrogen. This allows the production of a mixture of combustible gases not including nitrogen to any sensible extent and thus allows the combustible gas content (the content of carbon monoxide, hydrogen and methane) to be optimised. As nitrogen is an inert gas it is difficult to remove by any other method and its exclusion from the gas making process is a significant advantage that I have found to be provided by apparatus embodying the present invention.

It is further proposed that embodiments of the present invention will provide that the wall above the fluidised bed dividing the volumes between the differing bed sections (and the bed sections themselves) and that the walls surrounding the fluidised bed itself, be provided as part of a boiler system. In such an arrangement, making use of appropriate superheaters and economisers, more steam may be produced than is required to sustain the water gas reaction in the endothermically gas producing bed section. The excess of steam may be used to drive steam turbines and produce energy needed to drive fans, compressors, pumps and the like associated with the gas producing plant, and possibly even render surplus electrical power.

Conventional gas cleaning, cooling and converting equipment may be incorporated in apparatus embodying the invention to retain oxides of carbon in solution and provide means for the production of substantially pure hydrogen as an alternative end product gas thus making hydrogen directly from coal or other combustible materials in a total energy plant of high efficiency.

DESCRIPTION OF EMBODIMENTS

Figure 1:
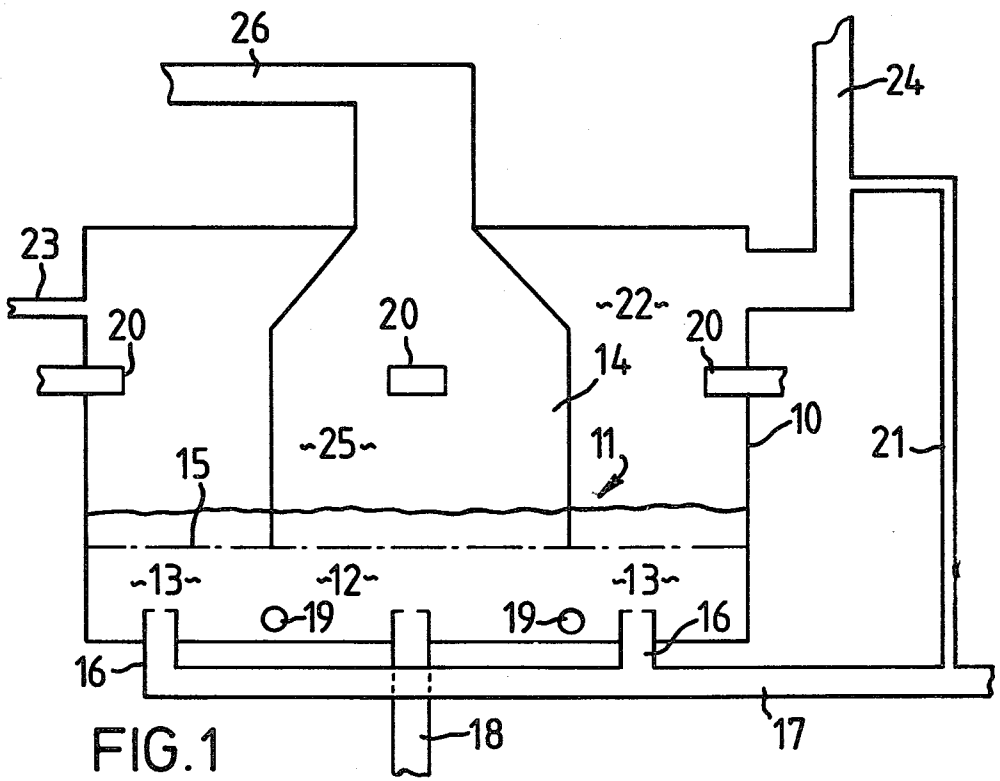
Figure 2:
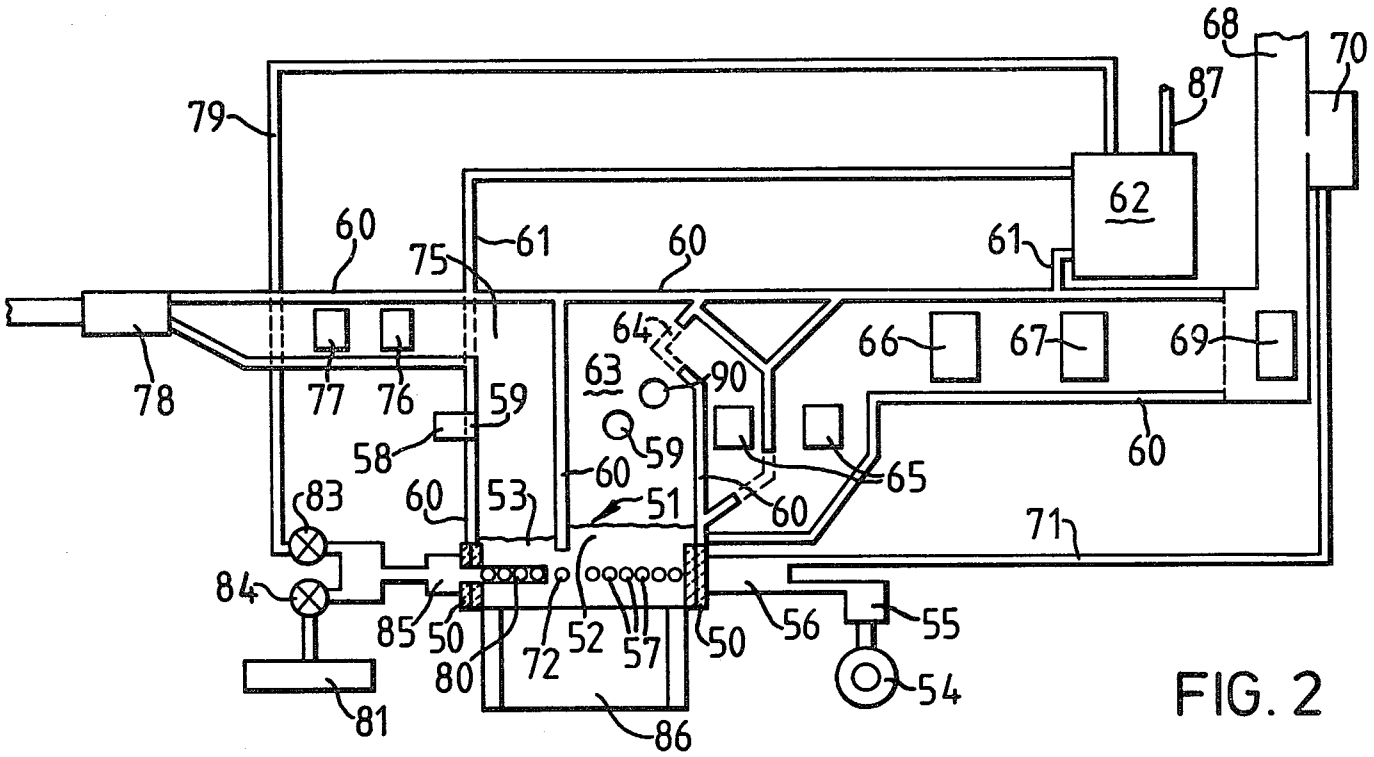
Figure 3:
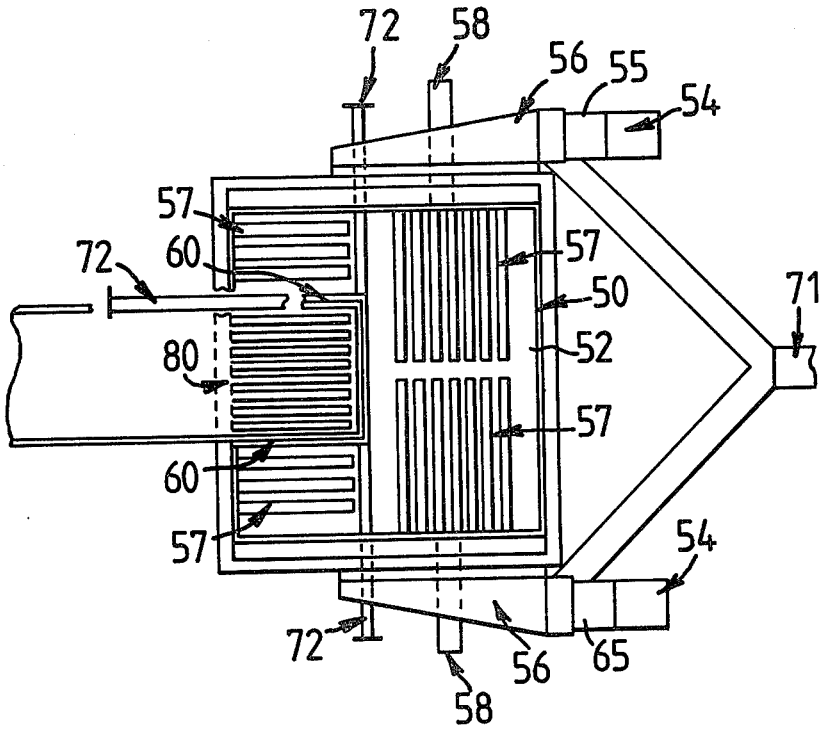

Embodiments of the invention will now be described with reference to the accompanying drawings in which:

FIG. 1 is a highly diagrammatic side view illustrating fluidised bed gas producing plant embodying the invention;

FIG. 2 diagrammatically illustrates in sectional side elevation gas producer plant embodying the invention in more detail; and FIG. 3 is a partial plan view of the plant shown in FIG. 2.

FIG. 1 illustrates the principle parts of an arrangement embodying the invention and shows it to include a tank 10 defining a fluidised bed 11 of finely divided inert particulate material. One section 12 of bed 11 is separated from the remainder 13 of the bed by a curtain wall 14 extending down to the surface of the bed when the bed is not being fluidised (dotted line 15 in FIG. 1). The sections 12 and 13 are fluidised separately.

The major part 13 of bed 11 is fluidised with air or a mixture of air and recycled flue gas by means 16 from a system 17 possibly including a heater and a mixer. Means 19, e.g. sparge pipes, located beneath the curtain wall 14 feeds steam into the bed. Section 12 of the bed 11 is fed with steam or a mixture of steam and oxygen by means 18.

When operated the upper surface of the bed 11 rises to cover the bottom edge of the wall 14, and the bed is fed with fuel, for example coal, by means 20. Section 13 is fed, as noted, with air (a mixture of nitrogen and oxygen) and perhaps with recycled flue gas and operates exothermically to incompletely combust fuel fed thereto. The incompletely burnt fuel evolving from section 13 passes into the volume 22 thereabove and extra air may be fed to that volume, by means 23, to enable substantially complete combustion of the products evolving from the bed to be completed before passing to a flue 24.

The isolated, endothermically operating bed section 12 receives steam or a steam and oxygen mix via means 18, and this gas or gas mixture reacts with fuel in secion 12 to produce a combustible-gas which is carried away from the volume 25 thereabove via a duct 26 as shown.

The endothermic reaction in bed section 12 is sustained by heat carried into bed section 12 with bed material transferring thereinto from bed section 13, and by convective heat transfer at the boundary. The transfer of bed material across the boundary of bed section 12 occurs naturally due to the horizontal and vertical cycling motion of the fluidised bed material but may be assisted in any suitable way such as by establishing a differential pressure across the different bed sections, or by using paddles or screw pumps (not shown). The migration of bed material across the boundary of bed section 12 is not accompanied by a migration of gases as transfer of gas across this boundary is prevented by the steam issuing from the sparge pipe 19 in the localised area of the bed beneath the edge of curtain wall 14, and the natural vertical directional flow of all the gases in the bed.

FIGS. 2 and 3 illustrate a practical example of a gas-producer plant embodying the invention and show it to include a wall 50 of, or lined with, a refractory material bounding a fluidised bed 51 divided into an exothermically operable, heat generating section 52 and an endothermically operable, combustible-gas producing section 53. Bed section 52 is supplied with air from fans 54 and oil or other suitable heaters 55 via plenum chambers 56, and an array of sparge pipes 57 as shown. The array of sparge pipes 57 extends through the material of the bed (sand or any other suitable inert, high temperature stable, particulate material) generally horizontally to discharge into the bed gas passed thereto so as to fluidise the bed section 52 and support combustion of fuel fed thereto.

Coal is supplied to both sections of the bed by feeders 58 discharging through openings 59 in diaphragm walls 60 which surround the volume above bed 51 (i.e. above the walls 50) and form a divider extending above and defining the boundary of the gas-producing bed section 53. Water in the walls 60 is heated and transferred via pipes 61 to a steam drum 62. Gases produced in the bed section 52 evolve into a space 63 thereabove (which is enclosed by the walls 60) and escapes from that volume via an outlet 64 leading to evaporator 65, steam superheater 66, and economiser 67 sections of a boiler. Means 90 are provided for injecting air into the volume 63 to enable substantially complete combustion of gases and solids evolving from bed section 52. These sections of the boiler may be arranged in the sequence shown or in any other particular chosen sequence (with perhaps one or more omitted) to suit operating parameters. Eventually the gas passes to a chimney 68 via a grit arrester 69. An induced draft fan (assisted if need be by a recyle gas fan) may be provided as shown at 70 to enable flue gases to be abstracted from flue 68 and passed, via line 71, to plenum chambers 56 and into the bed section 52.

Sparge pipes 72 run, as shown, beneath the wall 60 defining bed section 53, within the bed material and are fed with steam to form a vertical steam flow in the bed material enabling separation of gases evolving in bed section 12 from those evolving in bed section 13. The gas generated in section 53 discharges into the volume 75 thereabove and after passing over steam superheaters 76 and possibly economisers 77 passes to gas conversion plant 78 in which it is further cooled, cleaned and purified before use.

It will be noted that the diaphragm walls 60 surround the whole of the gas generating sections and may also (as shown) form part of the gas passages leading to the flue 68 and plant 78 to maximise heat transfer to the water in the walls.

FIG. 3 specifically illustrates the division of the two bed sections 52 and 53 of the bed 51 by the partition diaphragm wall 60 and steam sparge pipes 72.

Bed section 53 is fluidised by an array of sparge pipes 80 fed with steam from steam drum 62 via line 79 (which may or may not have added thereto a proportion of oxygen from an oxygen producing plant 81, a mixing a gases being controlled by valves 83 and 84 as shown) and a plenum chamber 85.

The recyled flue gas may be supplied via duct 71 as shown to provide cooling of bed 11 during the start-up procedure i.e. before steam is raised in the boiler.

To operate the plant bed section 52 is started by operating fans 54 and heaters 55 and coal or other fuel is fed to the bed section 52. As soon as section 52 reaches a predetermined operating temperature, for example a temperature in the range of 1000° C. to 1200° C. and the boiler part of the plant begins to produce steam, operation of bed section 53 may be started and fuel fed directly thereto by operation of the fuel feeds 58 associated therewith. Bed section 53 is desirably operated at a temperature approximately 100° C. below that of bed section 52, is: in the range 900° C. to 1100° C. depending upon the selected temperature for operation of bed section 52.

The quality of the gas produced in volume 75 is controlled by controlling the temperature of the bed 51, the rate of fuel feed, the amount and temperature of the steam supplied and the addition of oxygen from a suitable cryogenic or other source of storage, or an oxygen plant powered by energy recovered by the boiler section of the plant, if and when required.

It will be appreciated from the foregoing that the combustible-gas producer proposed is designed to operate autothermically and has a thermally autoregenerating low pressure fluidised bed unit. Autoregeneration is achieved by means of surrounding the combustible-gas producing bed section with a totally combusting fluidised bed arranged with controllable zones but with the fluidised bed including the combustible gas producing bed section formed as an uninterrupted particulate mass enabling the complete transmigration of bed material between bed sections.

When the total fluidised bed is energised by the respective fluidising gases the swelled bed effects sealing between the sections defined by the partition walls 60 and these walls become part of a waste heat boiler system included in the gas producer.

The fluidising gases distribution by horizontal sparge pipe system as herein described is one that is found particularly efficacious.

The combustible gas producer section, as noted above, operates endothermically and allowing for migration cycles within the bed heat flow into the gas producing bed section is balanced by cool particle migration thereoutof and into the surrounding parts of the bed. The exothermic operation of the major portion of the bed balances the endothermic operation of the gas producing section.

It will be noted that I provide that the combustible-gas producing bed section, which is generally smaller than the exothermically operable bed section due to the lower gas volume required for the endothermic reaction, is surrounded by the exothermically operated bed section such that the boundary area between the two bed sections is maximised enhancing and promoting heat transfer therebetween.

As described above heat transfer between the bed sections is effected by transfer of bed material between the sections caused by the natural motion, when fluidised, of the bed material with its associated transverse mass flow, and by convection circulation of the bed material.

Mass transfer of bed material within the bed from one section to another may be enhanced by establishing differential pressure between the differing bed sections (for example 75 mm to 100 mm water guage) and may also be assisted by mechanical means such as paddles, jet pumps or the like.

The rate of mass flow, and the temperature difference between the differing bed sections determines the rate of heat transfer therebetween and to sustain the reaction in the endothermically operating bed section and ensure effective operation of the plant embodying the invention, the temperatures of the differing bed sections need be controlled to ensure that the exothermically operated bed section operates at a higher temperature than the endothermically operated bed section.

It will be appreciated that various modifications may be made to the above described arrangements without departing from the scope of the present invention.

I claim:

1. A method of making combustible gas in which a single homogeneous bed of finely divided inert particulate material has gasses passed thereto to fluidise the bed material and in which fuel is fed to the bed for combustion, comprising;

(a) passing a first gas to one or more first sections of the bed via a first array of sparge tubes extending generally horizontally through the bed to fluidise the bed material therein and support an endothermic combustion of said fuel fed thereto to produce a combustible gas;

(b) passing a second gas to one or more second sections of the bed via a second array of sparge tubes extending generally horizontally through the bed material to fluidise the bed material therein and support an exothermic combustion of said fuel fed thereto to produce heat and flue gases;

(c) passing a third gas via a third array of sparge tubes extending generally horizontally through the bed material to fluidise the bed material at boundaries between the first section or sections and the second section or sections to prevent movement of gases across said boundaries;

(d) transferring the heat produced in step (b) to the first section or sections of step (a) to support the endothermic combustion thereof by migration of bed material and combusting fuel across said boundaries;

(e) maintaining the combustible gas evolving in step (a) separate from the flue gases evolving from step (b) via one or more gas impermeable walls, wherein said walls extend partially into the bed when the bed is fluidized but do not extend into the bed for any substantial distance and do not provide a physical barrier for the movement of gases or material between the bed sections.

2. A method according to claim 1, in which the bed is divided into one first bed section and one second bed section.

3. A method according to claim 2, in which said first gas is steam or steam enriched with oxygen, in which said second gas is air or a mixture of air and recycled flue gas and in which said third gas is steam.

4. A method according to claim 3, in which the steam fed to the bed material is generated by utilising the heat of gases evolving from the bed.

5. Apparatus for producing combustible gas comprising;

(a) a single homogeneous bed of finely divided particulate material;

(b) means for passing fuel to the bed for combustion;

(c) a first array of sparge tubes extending generally horizontally through the bed material for passing a first gas to one or more first sections of the bed of fluidise the bed material therein and support combustion of said fuel fed thereto, said first gas is such as to cause an endothermic combustion of said fuel in said first section or sections to produce a combustible gas;

(d) a second array of sparge tubes extending generally horizontally through the bed material for passing a second gas to one or more second sections of the bed to fluidise the bed material therein and support an exothermic combustion of said fuel fed thereto to produce heat and flue gases;

(e) means for transferring the heat produced in (d) to said first section or sections of (c) by migration of bed material and combusting fuel across boundaries between said first and said second sections;

(f) a third array of sparge tubes extending generally horizontally through the bed material for passing or third gas to the bed at the boundaries between said first and said second sections to prevent movement of gases across said boundaries;

(g) gas impermeable walls for maintaining the combustible gas evolving from the first bed section or sections separate from the flue gases evolving from the second bed section or sections, wherein said walls extend partially into the bed when said bed is fluidized but do not extend into the bed for any substantial distance and do not provide a physical barrier for the movement of gases or material between the bed sections.

6. Gas producer apparatus in accordance with claim 5, wherein the bed is divided into one first bed section and one second bed section.

7. Gas producer apparatus in accordance with claim 6, wherein said walls are diaphragm water walls forming part of a boiler.

8. Gas producer apparatus in accordance with claim 6, including steam generating means for producing steam, said steam alone or mixed with oxygen forms said first gas, and said steam alone forms said third gas.

9. Gas producer apparatus in accordance with claim 8, in which the steam generating means comprises a boiler, part of which is formed by said walls, said walls being diaphragm water walls.

10. Gas producer apparatus in accordance with claim 8, including means for feeding to said second array of sparge tubes air, or a mixture of air and recycled flue gas, as said second gas.

* * * * *